US006746290B2

(12) United States Patent
Nakata et al.

(10) Patent No.: US 6,746,290 B2
(45) Date of Patent: Jun. 8, 2004

(54) IDLE EXHAUST SYSTEM FOR OUTBOARD MOTOR

(75) Inventors: Jun Nakata, Shizuoka (JP); Toshiaki Sato, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/165,522

(22) Filed: Jun. 7, 2002

(65) Prior Publication Data

US 2002/0197921 A1 Dec. 26, 2002

(30) Foreign Application Priority Data

Jun. 20, 2001 (JP) ..... 2001-186411

(51) Int. Cl.[7] ..... B63H 21/38
(52) U.S. Cl. ..... 440/89 R; 440/89 D
(58) Field of Search ..... 440/89 R, 89, 440/89 A, 89 B, 89 C, 89 D, 89 G

(56) References Cited

U.S. PATENT DOCUMENTS

| | | | | |
|---|---|---|---|---|
| 4,604,069 A | | 8/1986 | Taguchi | |
| 4,607,723 A | | 8/1986 | Okazaki | |
| 5,232,387 A | | 8/1993 | Sumigawa | |
| 5,326,295 A | | 7/1994 | Nakayama | |
| 5,487,688 A | | 1/1996 | Sumigawa | |
| 5,954,022 A | * | 9/1999 | Katayama et al. | 123/195 P |
| 6,027,385 A | | 2/2000 | Katayama et al. | |
| 6,039,618 A | | 3/2000 | Hiraoka et al. | |

FOREIGN PATENT DOCUMENTS

| | | | |
|---|---|---|---|
| JP | 8-100625 | * | 4/1996 |

* cited by examiner

*Primary Examiner*—Sherman Basinger
(74) *Attorney, Agent, or Firm*—Knobbe, Martens, Olson & Bear, LLP

(57) ABSTRACT

An outboard motor includes a housing unit and an engine disposed above the housing unit. The engine defines a first exhaust passage to discharge exhaust gases from the engine and a lubricant passage through which lubricant flows. A lubricant reservoir member is disposed below the engine within the housing unit to define a lubricant reservoir therein. The lubricant passage communicates with the lubricant reservoir. A second exhaust passage, which can be defined on an outer surface of the lubricant reservoir member, extends along the height of the lubricant reservoir. The housing unit defines third and fourth exhaust passages. The third exhaust passage is arranged between the first and second exhaust passages. The fourth exhaust passage is arranged downstream of the second exhaust passage. The housing unit defines an exhaust discharge port at an end of the fourth exhaust passage. The exhaust discharge port communicates with the atmosphere.

40 Claims, 10 Drawing Sheets

IDLE EXHAUST SYSTEM FOR OUTBOARD MOTOR

PRIORITY INFORMATION

This application is based on and claims priority to Japanese Patent Application No. 2001-186411, filed Jun. 20, 2001, the entire contents of which is hereby expressly incorporated by reference.

BACKGROUND OF THE INVENTION

1. Field of the Invention

This invention relates generally to an idle exhaust system for an outboard motor, and more particularly to an improved idle exhaust system for discharging idle exhaust gases through an exhaust discharge port at a housing unit of an outboard motor.

2. Description of Related Art

An outboard motor typically includes a housing unit that can be mounted on an associated watercraft and an internal combustion engine disposed above the housing unit. A support member affixed to the top of the housing unit normally supports the engine. The housing unit carries a propulsion device such as, for example, a propeller to propel the watercraft. The engine powers the propulsion device with a driveshaft and a propulsion shaft extending through the housing unit.

Typically, the outboard motor employs an exhaust system to discharge exhaust gases from the engine. The exhaust system discharges exhaust gases produced at engine speed above idle to a body of water surrounding the outboard motor. The exhaust gases are discharged through, for example, an exhaust conduit and one or more expansion chambers provided in the housing unit and then through a submerged discharge port that is typically formed at a hub of a propeller.

When the engine speed is above idle, the exhaust pressure exceeds the back pressure caused by the body of water. The exhaust gases thus can exit through the submerged discharge port. At about idle speed, however, the exhaust pressure is less than the back pressure and the exhaust gases do not freely exit through the submerged port. An idle exhaust passage thus is provided to discharge exhaust gases that are produced at the idle speed to the atmosphere through an idle port defined at the housing unit above the waterline.

Typically, the idle exhaust system is branched off from the primary exhaust system. The housing unit defines an idle exhaust discharge port at an upper rear portion of the housing unit. An idle exhaust passage connects the discharge port with a portion of the primary exhaust system which is located most closely to the discharge port. For instance, the idle exhaust passage extends from the exhaust conduit or an exhaust passage defined within the support member. The idle exhaust passage thus is short. Although such a short passage does not occupy much space, exhaust energy at the idle speed is not sufficiently reduced. Accordingly, exhaust noise and temperature can be excessive.

SUMMARY OF THE INVENTION

A need therefore exists for an improved idle exhaust system for an outboard motor that can sufficiently reduce exhaust energy at idle speed.

In accordance with one aspect of the present invention, an outboard motor includes a housing unit adapted to be mounted on an associated watercraft, and an internal combustion engine disposed above the housing unit. The engine includes a first exhaust passage to discharge exhaust gases therefrom. A lubricant reservoir is disposed below the engine. The motor also includes a second exhaust passage communicating with the first exhaust passage and extending below the lubricant reservoir. The second exhaust passage extends to a first exhaust discharge port communicating with atmosphere. A third exhaust passage has an inlet communicating with the second exhaust passage at a point below the lubricant reservoir. Additionally, the third exhaust passage extends upwardly to a point at about the same elevation as an upper end of the lubricant reservoir, and extends to a second exhaust discharge port disposed higher than the first exhaust discharge port.

In accordance with another aspect of the present invention, an outboard motor comprises a housing unit adapted to be mounted on an associated watercraft. An internal combustion engine is disposed above the housing unit. The engine defines a first exhaust passage to discharge exhaust gases from the engine. The engine additionally defines a lubricant passage through which lubricant flows. A lubricant reservoir member is disposed below the engine within the housing unit to define a lubricant reservoir therein. The lubricant passage communicates with the lubricant reservoir. The lubricant reservoir member defines a second exhaust passage on an outer surface thereof. The housing unit defines third and fourth exhaust passages. The third exhaust passage connects the first and second exhaust passages. The fourth exhaust passage is arranged downstream of the second exhaust passage. The housing unit defines an exhaust discharge port at an end of the fourth exhaust passage. The exhaust discharge port communicates with atmosphere.

In accordance with a further aspect of the present invention, an outboard motor comprises a housing unit adapted to be mounted on an associated watercraft. An internal combustion engine is disposed above the housing unit. The engine defines a first exhaust passage to discharge exhaust gases from the engine. An exhaust conduit extends generally vertically within the housing unit. The exhaust conduit defines a second exhaust passage communicates with the first exhaust passage. The exhaust gases descends the second exhaust passage. A container is disposed below the engine within the housing unit. The container defines a third exhaust passage communicating with the second exhaust passage. The housing unit defines a fourth exhaust passage communicating with the third exhaust passage and defines an exhaust discharge port disposed at an end of the fourth exhaust passage. The exhaust discharge port communicates with atmosphere.

BRIEF DESCRIPTION OF THE DRAWINGS

These and other features, aspects and advantages of the present invention will now be described with reference to the drawings of a preferred embodiment, which is intended to illustrate and not to limit the invention. The drawings comprise ten figures.

DETAILED DESCRIPTION OF THE PREFERRED EMBODIMENT OF THE INVENTION

Figure 1:
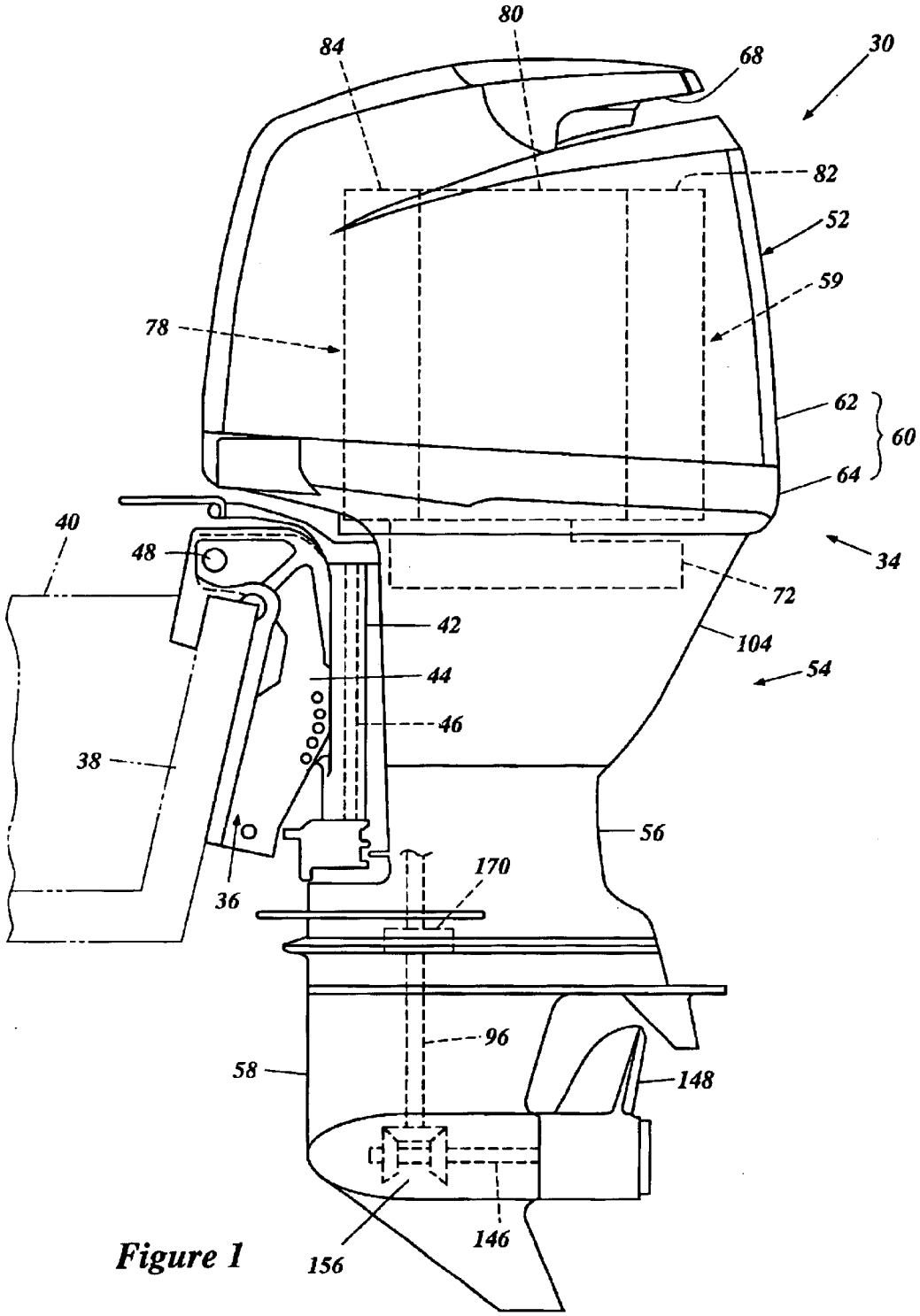
FIG. 1 is a side elevational view of an outboard motor configured in accordance with a preferred embodiment of the present invention. An associated watercraft is shown in phantom.
Figure 2:
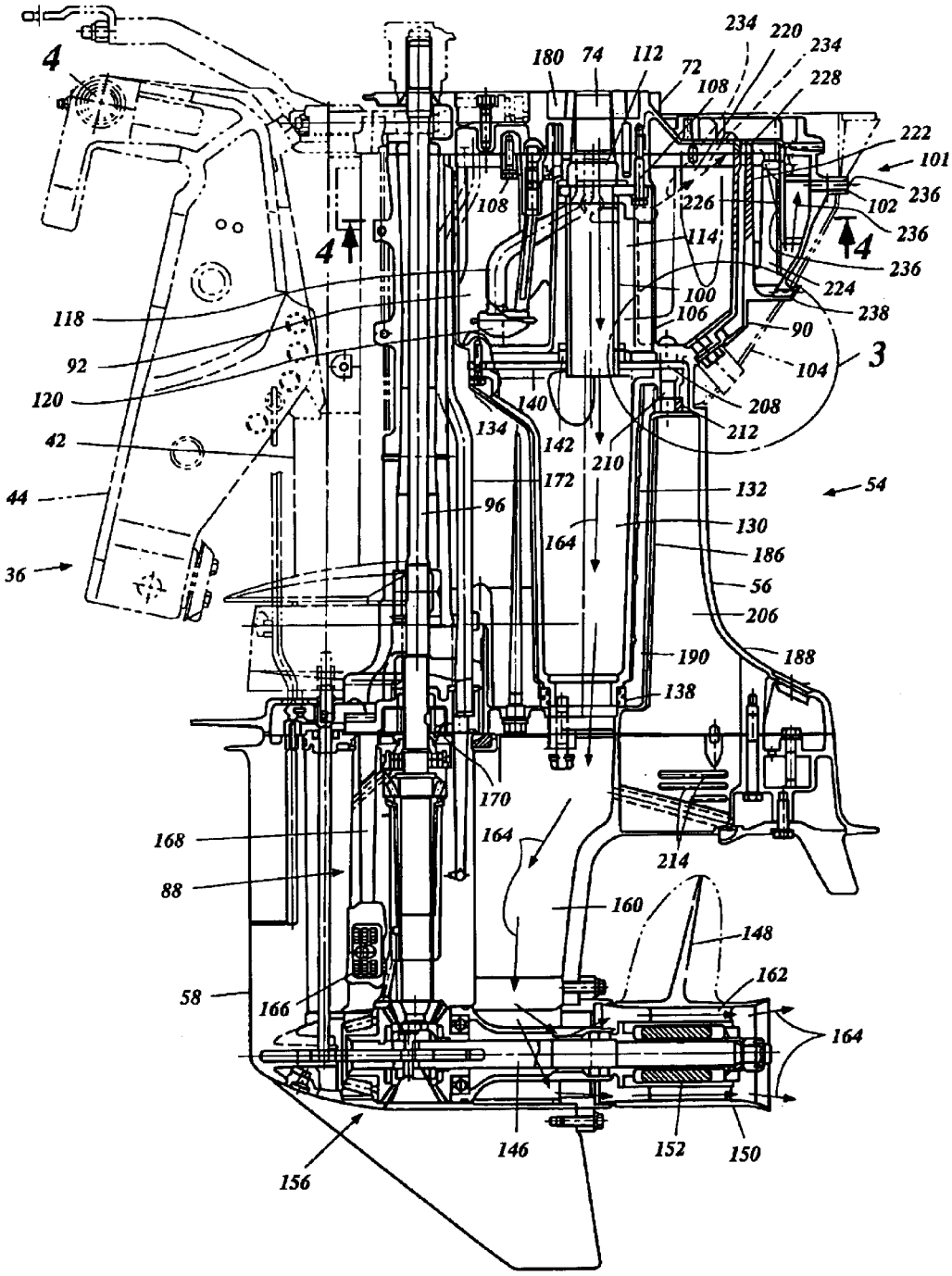
FIG. 2 is an enlarged side elevational and partial sectional view of a housing unit of the outboard motor. An exhaust guide member and a bracket assembly are also illustrated with the housing unit.

With particular reference to FIGS. 1 and 2, an overall construction of an outboard motor 30 configured in accordance with certain features, aspects and advantages of the present invention will be described.

In the illustrated arrangement, the outboard motor 30 comprises a drive unit 34 and a bracket assembly 36. The bracket assembly 36 supports the drive unit 34 on a transom 38 of an associated watercraft 40 and places a marine propulsion device in a submerged position with the watercraft 40 resting on the surface of a body of water. The bracket assembly 36 preferably comprises a swivel bracket 42, a clamping bracket 44, a steering shaft 46 and a pivot pin 48.

The steering shaft 46 typically extends through the swivel bracket 42 and is affixed to the drive unit 34 with upper and lower mount assemblies. The steering shaft 46 is pivotally journaled for steering movement about a generally vertically extending steering axis defined within the swivel bracket 42. The clamping bracket 44 comprises a pair of bracket arms that are spaced apart from each other and that are affixed to the watercraft transom 38. The pivot pin 48 completes a hinge coupling between the swivel bracket 42 and the clamping bracket 44. The pivot pin 48 extends through the bracket arms so that the clamping bracket 44 supports the swivel bracket 42 for pivotal movement about a generally horizontally extending tilt axis defined by the pivot pin 48. The drive unit 34 thus can be tilted or trimmed about the tilt axis.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system preferably is provided between the swivel bracket 42 and the clamping bracket 44 to tilt (raise or lower) the swivel bracket 42 and the drive unit 34 relative to the clamping bracket 44 Otherwise, the outboard motor 30 can have a manually operated system for tilting the drive unit 34. Typically, the term "tilt movement," when used in a broad sense, comprises both a tilt movement and a trim adjustment movement.

The illustrated drive unit 34 comprises a power head 52 and a housing unit 54 which includes a driveshaft housing 56 and a lower unit 58. The power head 52 is disposed atop the drive unit 34 and houses an internal combustion engine 59 that is positioned within a protective cowling 60. Preferably, the protective cowling 60 defines a generally closed cavity in which the engine 59 is disposed. The protective cowling 60 preferably comprises a top cowling member 62 and a bottom cowling member 64. The top cowling member 62 preferably is detachably affixed to the bottom cowling member 64 by a coupling mechanism so that a user, operator, mechanic or repairperson can access the engine 59 for maintenance or for other purposes.

The top cowling member 62 preferably defines at least one air intake opening 68 and at least one air duct disposed on its rear and top portion. Ambient air is drawn into the closed cavity through the opening 68 and then through the duct. Typically, the top cowling member 60 tapers in girth toward its top surface, which is in the general proximity of the air intake opening 68.

The bottom cowling member 64 preferably has an opening at its bottom portion through which an upper portion of an exhaust guide member or support member 72 extends. The exhaust guide member 72 preferably is made of an aluminum based alloy and is affixed atop the driveshaft housing 56. In other words, the exhaust guide member 72 is mounted on the driveshaft housing 56.

The bottom cowling member 64 and the exhaust guide member 72 together generally form a tray. The engine 59 is placed onto this tray and is affixed to the exhaust guide member 72. In other words, the exhaust guide member 72 supports the engine 59. The exhaust guide member 72 also defines an exhaust passage 74 through which burnt charges (e.g., exhaust gases) from the engine 59 are discharged.

The engine 59 in the illustrated embodiment operates on a four-cycle combustion principle. This type of engine, however, merely exemplifies one type of engine. Engines operating on other combustion principles (e.g., crankcase compression two-stroke or rotary) can be employed. Engines can have any numbers of cylinders, any cylinder arrangements (In-line, V-configuration or opposing). Regardless of any particular construction, the engine 59 comprises an engine body 78.

The engine body 78 preferably comprises a cylinder block 80, a cylinder head assembly 82 and a crankcase member 84. The cylinder block 80 defines cylinder bores in which pistons reciprocate. The cylinder head assembly 82 is affixed to the cylinder block 80 to define combustion chambers with the cylinder bores and the pistons. The crankcase member 84 is affixed to the cylinder block 80 opposite to the cylinder head assembly 82 to define a crankcase chamber. A crankshaft (not shown) is journaled for rotation in the crankcase chamber and is connected with the pistons. The crankshaft thus is rotated with the pistons reciprocation of the pistons.

The engine 59 preferably comprises an air intake system, a fuel supply system, an ignition system and an exhaust system. The air intake system draws air from within the cavity of the cowling assembly 60 to the combustion chambers. The fuel supply system supplies fuel to the combustion chambers. Various fuel supply systems such as, for example, fuel injection systems and carburetors can be applied. The ignition system fires air/fuel charges formed by the air intake system and the fuel supply system in the combustion chambers at proper timings. Burnt charges, i.e., exhaust gases are routed by the exhaust system. The engine body 78 defines inner exhaust passages connected to the combustion chambers. An exhaust manifold is connected to the inner exhaust passages to collect exhaust gases coming from the respective exhaust passages. The exhaust manifold defines an exhaust port of the engine and is connected to the exhaust passage 74 of the exhaust guide member 72.

The engine 59 builds heat during the operation. In order to cool the engine body 78, a water jacket (not shown) preferably is defined within the engine body 78. A cooling water transfer system 88 is provided to deliver cooling water to the water jacket and to discharge the water from the water jacket. Preferably, an open loop system is applied as the water transfer system 88.

The engine 59 preferably comprises a lubrication system to deliver lubricant oil to engine portions that need lubrication. A closed loop system preferably is employed in this arrangement. The lubrication system comprises at least one lubricant passage (not shown) defined within the engine body 78 and a lubricant reservoir member or lubricant container 90. The reservoir member 90 is disposed below the engine 59 within the driveshaft housing 56 to define a lubricant reservoir 92. Lubricant oil is supplied from the lubricant reservoir 92 to the engine portions and then the lubricant oil returns back to the reservoir 92.

With particular reference to FIGS. 1 and 2, the driveshaft housing 56 is positioned below the exhaust guide member 72. A driveshaft 96 preferably extends generally vertically through an opening formed at forward portions of the engine body 78, the exhaust guide member 72 and the driveshaft housing 56 to be coupled with the crankshaft at a bottom portion of the engine body 78. The driveshaft 96 is journaled for rotation in the driveshaft housing 56 and is driven by the crankshaft.

The driveshaft housing 56 defines internal exhaust sections. A first exhaust conduit 100 forms one of the exhaust sections. The exhaust conduit 100 defines an exhaust passage that is coupled with the exhaust passage 74 of the exhaust guide member 72 to convey the exhaust gases to other downstream exhaust sections disposed downstream.

The internal exhaust sections includes an idle discharge section 101 that is branched off from the downstream exhaust sections to discharge exhaust gases to the atmosphere under idle operation of the engine 59. A relatively small idle exhaust discharge port 102 preferably is opened at an upper rear portion of the driveshaft housing 56. The idle discharge section 101 is described in greater detail below with reference to FIGS. 2–4 and 6–10.

An apron 104 covers an upper portion of the driveshaft housing 56 and the exhaust guide member 72 to improve appearance of the housing unit 54. The apron 104 has openings through which at least the exhaust discharge port 102 can communicate exterior of the apron 104.

Figure 3:
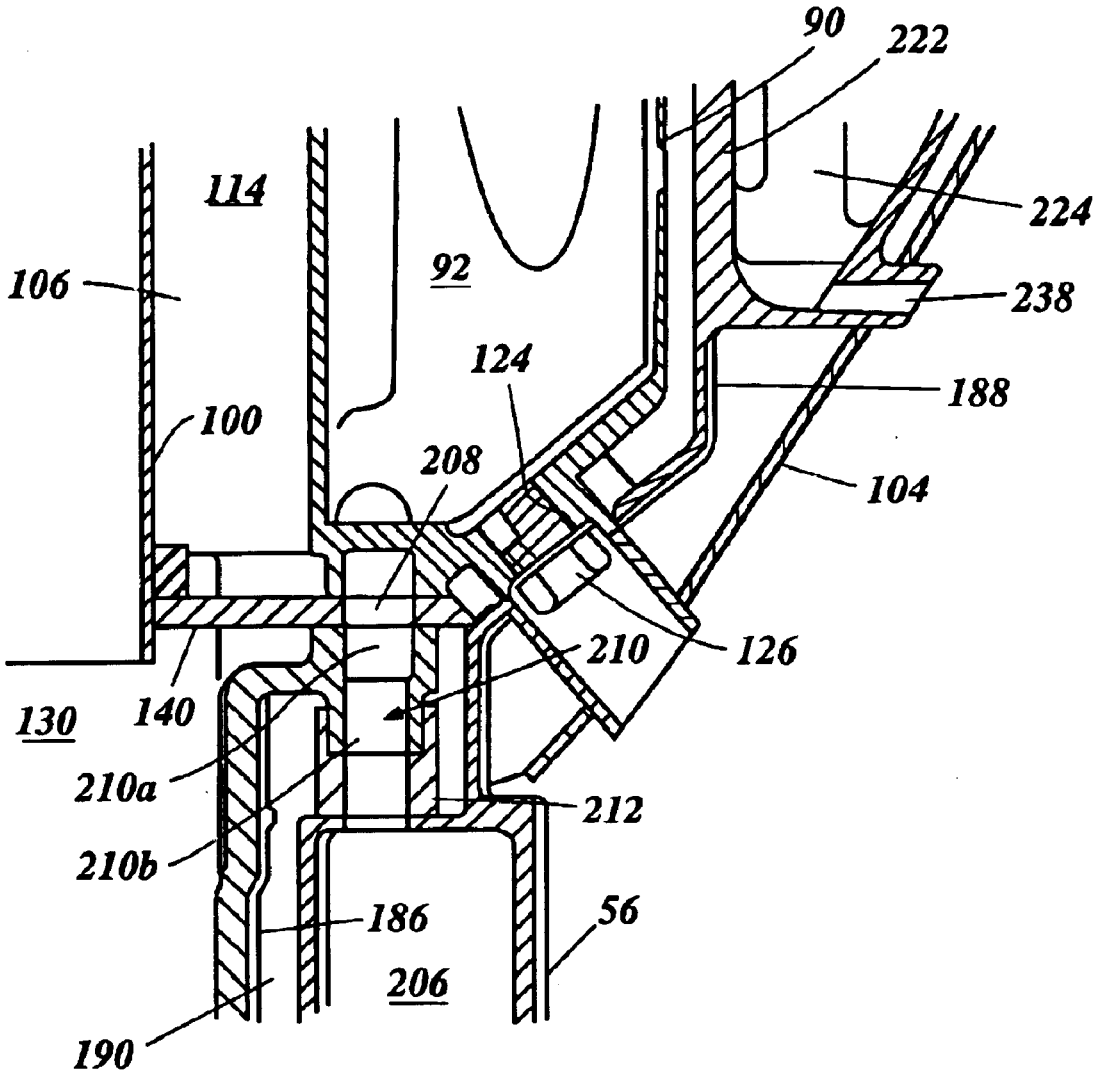
FIG. 3 is an enlarged side view of a portion of the outboard motor encircled by a phantom line 3 of FIG. 2.
Figure 4:
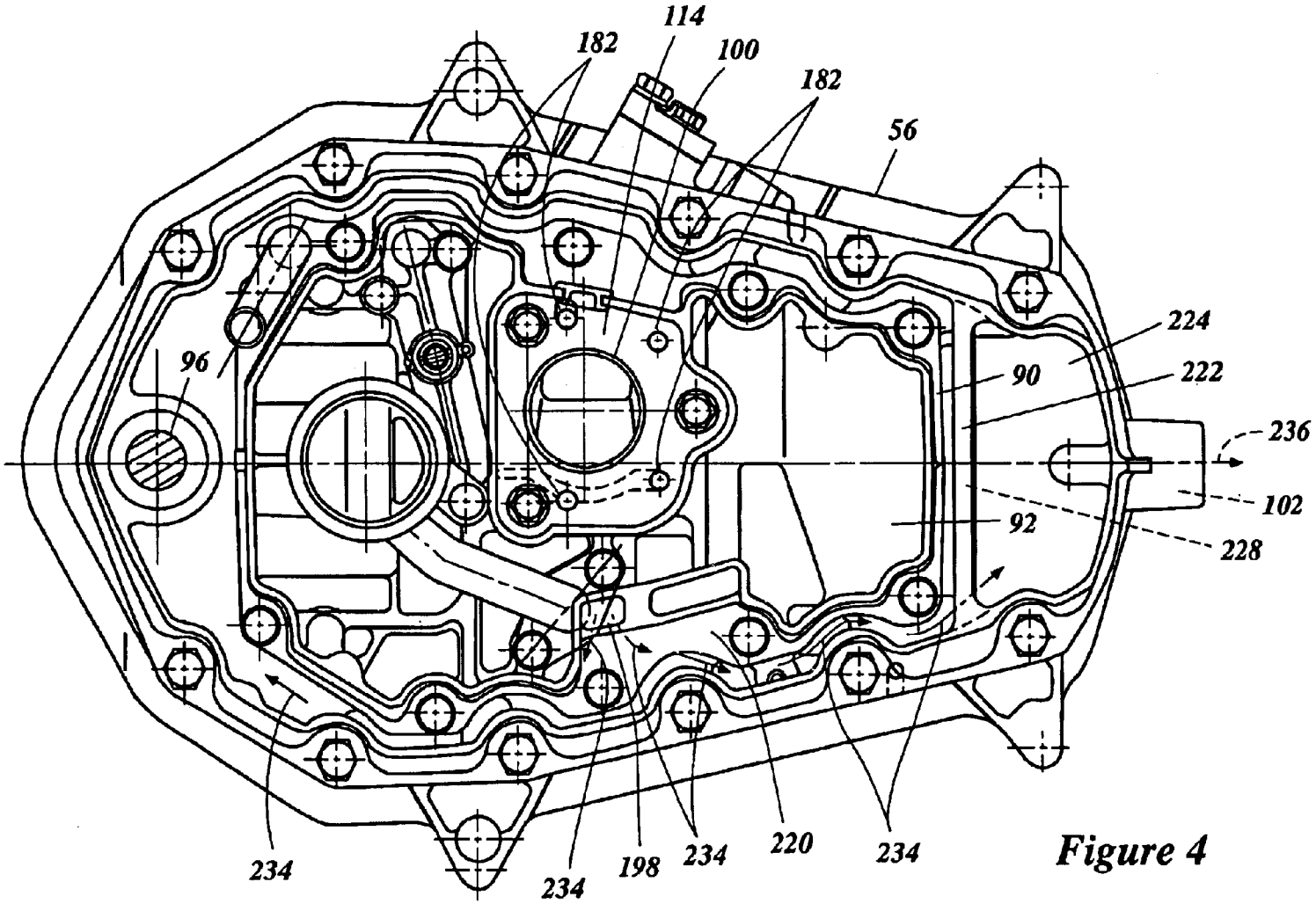
FIG. 4 is a partial sectional view of the outboard motor taken along the line 4—4 of FIG. 2 showing a bottom plan view of an upper surface of a lubricant reservoir disposed therein.

With reference to FIGS. 2–4, the reservoir member 90 preferably depends from the exhaust guide member 72. The reservoir member 90 generally forms a donut shaped recess that opens upwardly to define the lubricant reservoir 92. The reservoir member 90 also defines a reversed recess 106 that opens downwardly at a center of the donut shape recess. The reservoir member 90 is affixed to a bottom surface of the exhaust guide member 72 by bolts 108.

The exhaust conduit 100 extends through the downwardly opening recess 106 and has a flange that is affixed to the center portion of the reservoir member 90 in common with the reservoir member 90 by some of the bolts 108. The center portion of the reservoir member 90 defines an exhaust path 112 through which the exhaust passage 74 of the exhaust guide member 72 communicates with the exhaust passage defined by the exhaust conduit 100. The reservoir member 90 surrounds the exhaust conduit 100 with a certain distance. A space 114 thus is formed between an inner surface of the downward recess 106 and an outer surface of the exhaust conduit 100.

A suction pipe 118 extends from a bottom portion of the lubricant reservoir 92 upwardly toward the lubricant passage within the engine body 78. An oil filter 120 is attached to remove foreign substances from the lubricant oil before passing through the suction pipe 118. An oil pump (not shown) preferably is coupled with the driveshaft 96 or the crankshaft to pressurize and thereby move the lubricant from the section pipe 118 to the engine portions. As described above, the lubricant delivered to the engine 59 travels within the engine body 78 to lubricate the engine portions such as, for example, the crankshaft and the pistons. The lubricant that has lubricated the engine portions falls to the lubricant reservoir 92 by its own weight.

With particular reference to FIG. 3, a drain hole 124 is defined at a bottom of the reservoir member 90 to drain the lubricant in the reservoir 92 to a location out of the outboard motor 30. Normally, a closure bolt 126 is fitted into the drain hole 124 to close the hole 124.

With reference to FIG. 2, a first expansion chamber 130 preferably is defined below the first exhaust conduit 100 in the driveshaft housing 56. In the illustrated arrangement, a second exhaust conduit 132, which is generally shaped as a jar, depends from a bottom of the reservoir member 90 to form the first expansion chamber 130 therein.

The second exhaust conduit 132 has a top opening which has an inner diameter larger than an outer diameter of the exhaust conduit 100 and a lowermost portion of the exhaust conduit 100 slightly extends into the expansion chamber 130. The top opening of the second exhaust conduit 132 is provided with a flange 133 (FIG. 10) and the second exhaust conduit 132 is affixed to the bottom of the reservoir member 90 with the flange 133 by bolts 134.

The second exhaust conduit 132 defines a recessed portion 136 of the idle exhaust section 101 at the flange 133. The first expansion chamber 130 communicates with the recessed portion 136 through a communicating port 137. The second exhaust conduit 132 tapers in girth toward a bottom thereof and is seated on a pedestal formed at an inner bottom portion of the driveshaft housing 56 via a seal member 138. The bottom of the second exhaust conduit 132 defines an opening that opens toward the lower unit 58.

Preferably, a partition 140 (FIGS. 2 and 3) generally separates the first expansion chamber 130 from the space 114 defined above the chamber 130. The partition 140 is affixed to the bottom of the reservoir member 90 together with the flange of the second exhaust conduit 132. The first exhaust conduit 100 is provided with a flange that leans against the partition 140. A seal member 142 is interposed between the flange and the partition 140 to inhibit exhaust gases from moving to the space 114 from the first expansion chamber 130. The partition 140 defines an aperture 143 (FIG. 9) through which the exhaust conduit 100 passes to the first expansion chamber 130. The partition 140 also defines another aperture 144 at a forward portion thereof and the first expansion chamber 130 communicates with the space 114 through the aperture 144. The partition 140 further defines an aperture 145 communicating with the recessed portion 136 of the second exhaust conduit 132.

With continued reference to FIG. 2, the lower unit 58 depends from the driveshaft housing 56 and supports a propulsion shaft 146, which is driven by the driveshaft 96. The propulsion shaft 146 extends generally horizontally through the lower unit 58. A propulsion device is attached to the propulsion shaft 146 to be driven by the propulsion shaft 146. In the illustrated arrangement, the propulsion device includes a propeller 148 affixed to an outer end of the propulsion shaft 146. More specifically, a hub 150 of the propeller 148 is mounted on the propulsion shaft 146 with a rubber damper 152. The propulsion device, however, can take the form of a dual counter-rotating system, a hydrodynamic jet, or any of a number of other suitable propulsion devices.

A transmission 156 preferably is provided between the driveshaft 96 and the propulsion shaft 146. The transmission 156 couples together the two shafts 96, 146 which lie generally normal to each other (i.e., at a 90° shaft angle) with bevel gears. The outboard motor 30 has a clutch mechanism that allows the transmission 156 to change the rotational direction of the propeller 148 among forward, neutral or reverse.

The lower unit 58 also defines an internal passage of the exhaust system. A second expansion chamber 160 defines a major volume of the passage and is formed above a space where the propulsion shaft 146 extends. The second expansion chamber 160 is tapered downwardly like the first expansion chamber 130. The second expansion chamber 160 communicates with the first expansion chamber 130 and with an exhaust discharge path 162 defined at the hub 150 of the propeller 148.

At engine speeds above idle, the exhaust gases coming from the engine 59 descend the exhaust passage 74 of the exhaust guide member 72, the exhaust passage of the exhaust conduit 100, the first and second expansion chambers 130, 160 and then exits to the body of water through the discharge path 162 of the propeller 148 as indicated by the arrows 164 of FIG. 2. Because the gases expand and contract twice within the first and second expansion chambers 130, 160, exhaust noise is advantageously attenuated.

At idle speed, the exhaust gases flow to the idle exhaust section 101 and is discharged through the idle discharge port 102. The difference in the locations of the discharges accounts for the differences in pressure at locations above the waterline and below the waterline. Because the opening above the waterline, i.e., the idle discharge port 102, is smaller, pressure develops within the lower unit 58. When the pressure exceeds the higher pressure found below the waterline, the exhaust gases exit through the hub 150 of the propeller 148. If the pressure remains below the pressure found below the waterline, the exhaust gases exit through the idle discharge section above the waterline.

With particular reference to FIG. 2, the lower unit 58 preferably forms a water inlet 166 at a side surface on the port side. Alternatively, one or more water inlets can be formed on each sides. A water delivery passage 168 is defined within the lower unit 58 and extends generally vertically along the driveshaft 96 from the water inlet 166 toward the bottom of the driveshaft housing 56.

A water pump 170 is mounted on the driveshaft 96 at the bottom of the driveshaft housing 56 to be driven thereby and the water passage 168 is connected to the water pump 170. A water delivery conduit 172 extends generally vertically along the driveshaft 96 from the water pump 170 toward the engine 59. The water delivery conduit 172 is connected to the water jacket of the engine body 78. The water jacket is bifurcated at a bottom portion of the engine body 78 to define a branch water path that goes toward the exhaust guide member 72.

Cooling water is taken from the body of water around the housing unit 54. The water is drawn through the water inlet 166. The water moves up through the water passage 168 to the water pump 170. The water pump 170 pressurizes and thereby moves the water the water jacket of the engine body 78 through the water delivery conduit 172. While a major part of the water travels through the water jacket to cool the engine body 78, a small part of the water moves toward the exhaust guide member 72 through the branch water path.

Figure 5:
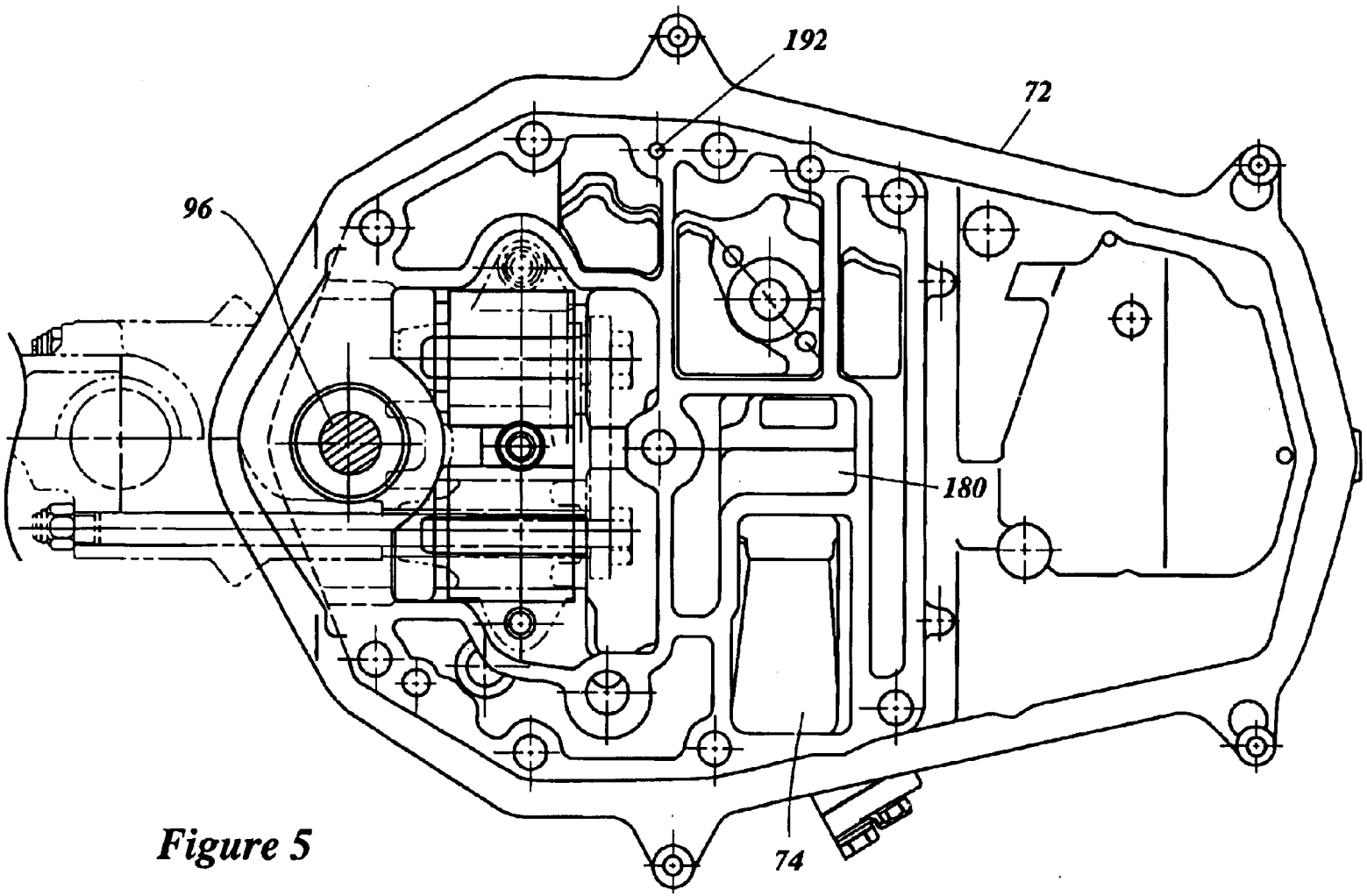
FIG. 5 is a top plan view of the exhaust guide member of FIG. 2.
Figure 6:
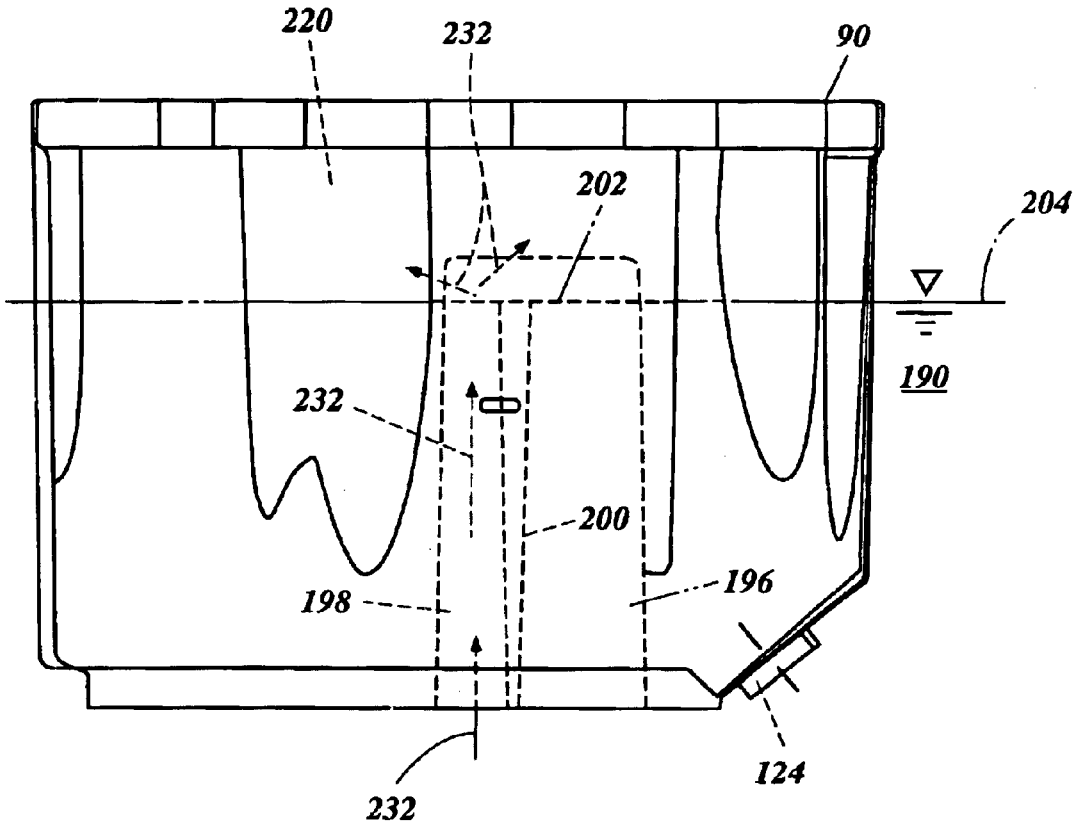
FIG. 6 is a side elevational view of the lubricant reservoir member of the outboard motor.

The exhaust guide member 72 defines a water discharge passage 180 (FIGS. 2 and 5) communicating with the water jacket. The water discharge passage 180 extends close to the exhaust passage 74 as shown in FIG. 5. The water that has traveled through the water jacket and therefore now is hot moves down through the water discharge passage 180.

Figure 7:
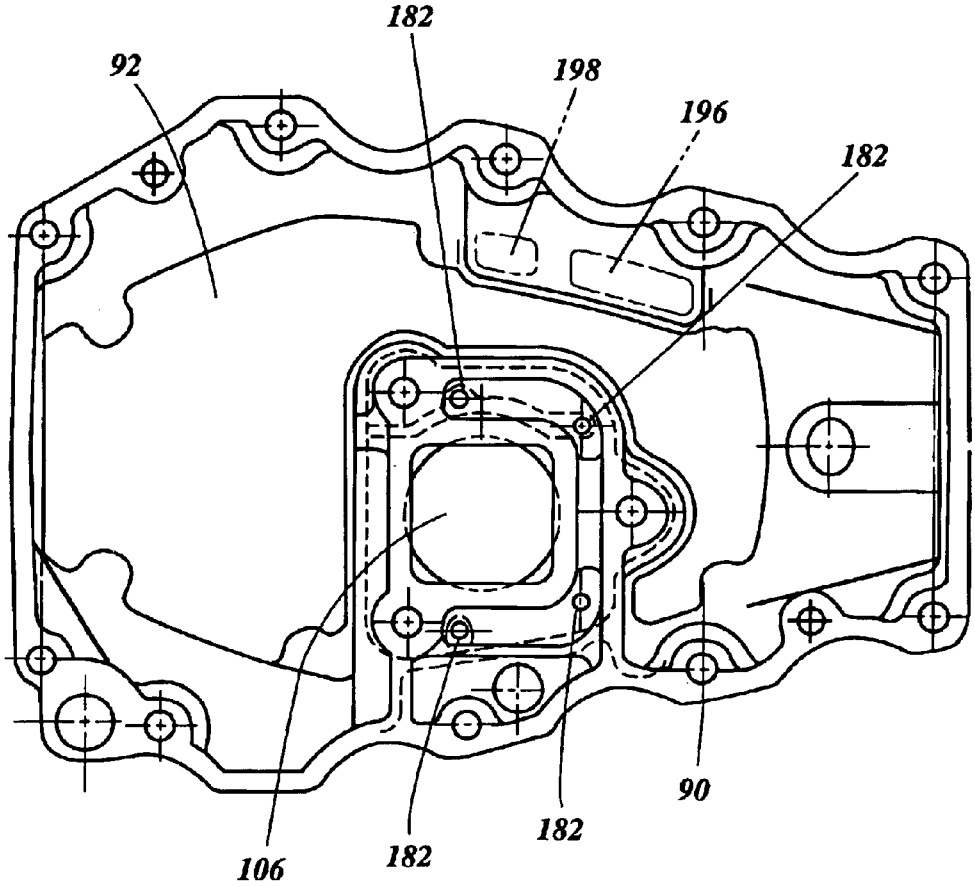
FIG. 7 is a top plan view of the lubricant reservoir member of FIG. 6.
Figure 8:
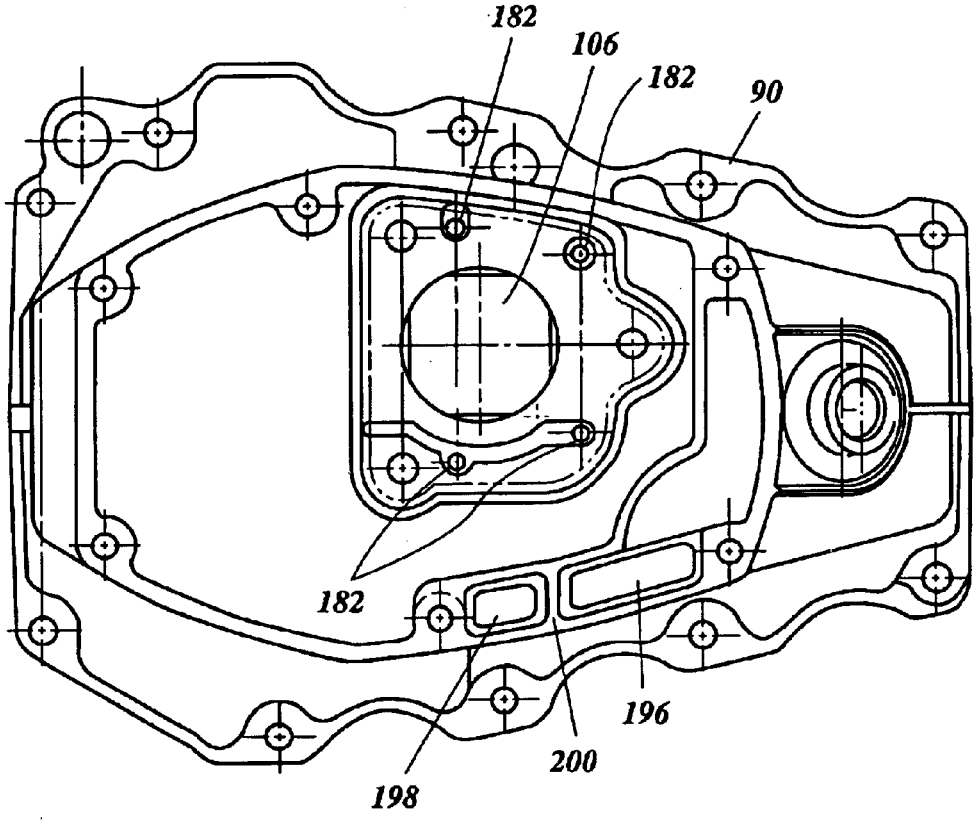
FIG. 8 is a bottom plan view of the lubricant reservoir member of FIG. 6.
Figure 9:
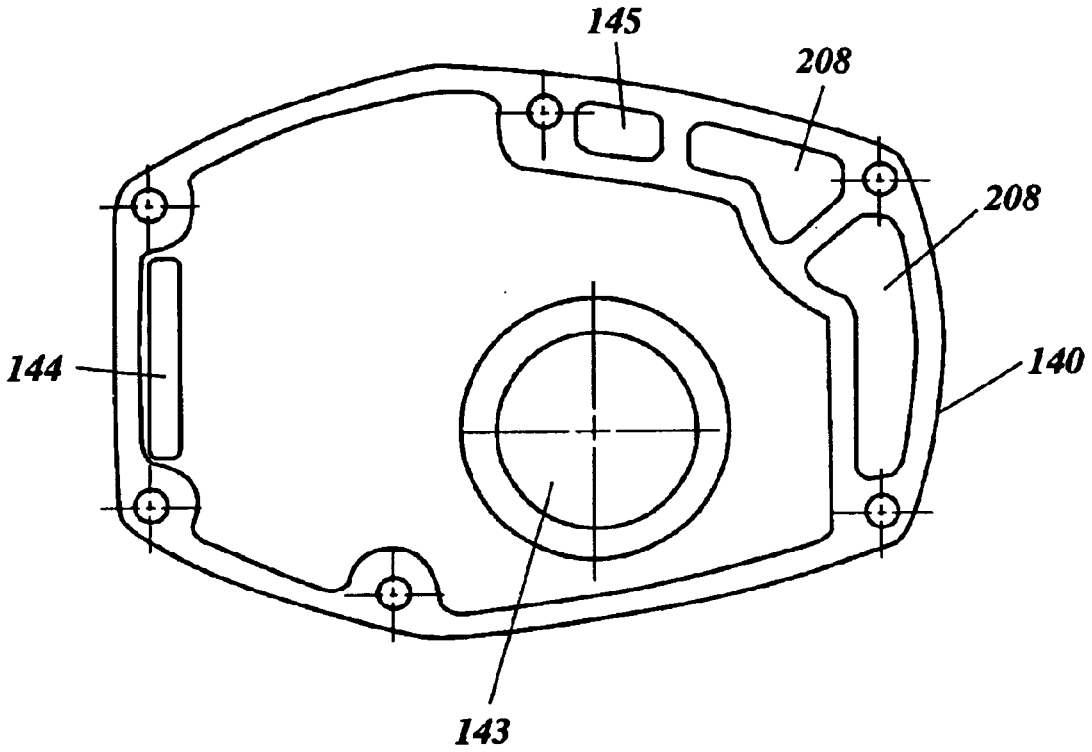
FIG. 9 is a top plan view of a partition of the outboard motor.
Figure 10:
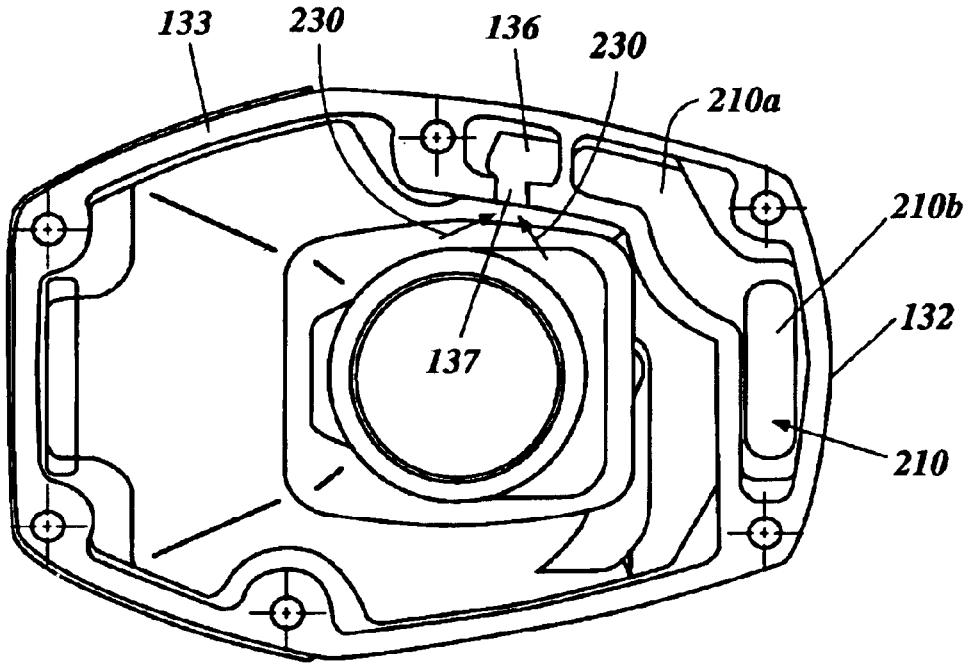
FIG. 10 is a top plan view of a second exhaust conduit of the outboard motor.

The discharge passage 180 of the exhaust guide member 72 communicates with the space 114 through apertures 182 FIGS. 4, 7 and 8) defined by the exhaust guide member 72 and the lubricant reservoir member 90. The water in the discharge passage 180 thus moves to the space 114 through the apertures 182 and flows down toward the partition 140 along an outer surface of the first exhaust conduit 100. Because the partition 140 generally separates the space 114 from the first expansion chamber 130, the water can accumulate within the space 114. The space 114 thus defines a first water pool. Because the partition 140 has the aperture 144 (FIG. 9), the water can gradually move to the first expansion chamber 130 through the aperture 144. The water then moves down through the first and second expansion chambers 130, 160 and exits to the body of water through the discharge path 162 of the propeller hub 150 with the exhaust gases.

In the illustrated arrangement, the water can cool down the first exhaust conduit 100 when flowing down along the outer surface of the first exhaust conduit 100 and temporarily accumulating in the first water pool 114. The water also cools the lubricant reservoir member 90 at a portion that defines the reversed recess 106. Additionally, the water cools the second exhaust conduit 132 and the lower unit portion defining the first and second expansion chambers 130, 160, respectively, and then the propeller hub 150.

The propeller hub 150 includes the rubber damper 152 which can be deteriorated by heat. If the water did not pass through the discharge path 162, the rubber damper 152 might be heated by the exhaust gases passing through the discharge path 162 because the exhaust gases, which are discharged under relatively high pressure, displaces the water coming from outside to this path 162. The water coming from the expansion chamber 160, however, passes through the discharge path 162 along with the exhaust gases in the illustrated arrangement. The rubber damper 152 thus is cooled with the water.

Additionally, the water that flows with the exhaust gases can contribute to reduce the exhaust noise because the water can lower the energy level of the exhaust gases.

With particular reference to FIGS. 2 and 3, the driveshaft housing 56 preferably defines an internal wall 186 that surrounds the second exhaust conduit 132. The internal wall 186 merges an outer wall 188 of the driveshaft housing 56 at a portion thereof generally surrounding the reservoir member 90. The internal wall 186 and the outer wall 188 together form a space or second water pool 190 around the first expansion chamber 130 and the reservoir member 90. The water in the branch water path moves down to the space 190 through a hole 192 (FIG. 5) defined in the exhaust guide member 72.

With continued reference to FIGS. 2 and 3 and with additional reference to FIGS. 6–10, the reservoir member 90 preferably defines a water discharge path 196 and an idle exhaust path 198 (best shown in FIG. 6) on a side surface of the starboard side. The water discharge path 196 and the idle exhaust path 198 extend generally vertically and parallel to each other. A wall portion 200 (FIGS. 6 and 8) separates the idle exhaust path 198 from the water discharge path 196.

The idle exhaust path 198 communicates with the aperture 145 of the partition 140. The water discharge path 196 defines a spillway or weir 202 atop thereof to regulate a water level 204 in the second water pool 190. The water discharge path 196 communicates with a water discharge guide 206 (FIGS. 2 and 3) formed between the internal wall 186 and the outer wall 188 of the driveshaft housing 56 through apertures 208 (FIGS. 2, 3 and 9) defined at the partition 140 and a connecting passage 210 (FIGS. 2 and 3).

The connecting passage 210 comprises a recessed portion 210*a* defined next to the recessed portion 136 of the idle exhaust section 101 and an aperture 210*b*. Spilled water thus moves to the water discharge guide 206 through the water discharge path 196 on the lubricant reservoir member 90, the apertures 208 of the partition 140, and the connecting passage 210 defined by the second exhaust conduit 132. A lower portion of the connecting passage 210 preferably is formed with a rubber tube 212.

Proximate the bottom of the water discharge guide 206, the lower unit 58 defines several slots 214 (FIG. 2) on both side surfaces so that the water discharge guide 206 communicates with locations outside of the housing unit 54 therethrough. Alternatively, either the side surface on the port side or the starboard side may define the slots 214. The water thus is discharged outside through the slots 214.

In the illustrated arrangement, the water in the branch water path is a portion of water divided from the water that is going to be delivered to the water jacket. The water thus is fresh and relatively cold. Accordingly, the lubricant reservoir member 90 and the second exhaust conduit 132 surrounded by the water can be cooled.

The water in the second water pool directly contacts the outer wall 188 of the driveshaft housing 56. Also, the water in the second water pool 190 around the second exhaust conduit 132 isolates the water discharge guide 206 from the first expansion chamber 130. The water further flows through the water discharge guide 206 and along the outer wall 188. The outer wall 188 thus is always isolated from the hot water that has traveled through the engine body 78 and can be cooled with the relatively cold water which prevents the outer wall 188 from becoming white. The good appearance of the driveshaft housing 56 can be thus maintained.

With particular reference to FIGS. 2–4, the idle exhaust path 198 communicates with an empty space or non-water area 220 which is defined by the driveshaft housing 56 and the lubricant reservoir member 90 above the second water pool. The non-water area 220 generally forms a circular expansion chamber that surrounds the lubricant reservoir member 90. Thus, the idle exhaust path 198 is defined in part, by the upper surface of the water pooled in the second water pool 190.

The non-water area 220 defines a greater cross sectional flow area than the idle exhaust path 198 and thus defines a first idle expansion chamber. Thus, the upper surface of the water pooled in the second water pool 190 defines a lower surface of the first idle expansion chamber.

A vertical inner wall 222 (FIGS. 2–4) of the driveshaft housing 56 defines a second idle expansion chamber 224 together with the outer wall 188. Several incomplete partitions 226 can be provided to make a labyrinth construction within the second idle expansion chamber 224. The vertical inner wall 222 is spaced from the exhaust guide member 72 and thus defines a slot 228 (FIGS. 2 and 4) through which the non-water area, i.e., the first idle expansion chamber 220 communicates with the second idle expansion chamber 224.

At the idle speed, the exhaust gases from the first expansion chamber 130 move into the idle exhaust section 101 because the back pressure by the water does not allow the exhaust gases to exit through the exhaust discharge path 162 of the propeller hub 150. The exhaust gases move to the recessed portion 136 of the second exhaust conduit 132 through the communicating port 137 as indicated by the arrows 230 of FIG. 10. The exhaust gases then go up through the aperture 145 of the partition 140 (FIG. 9) to the idle exhaust path 198 of the lubricant reservoir member 90. The exhaust gases ascend the idle exhaust path 198 to the non-water area 220 as indicated by the arrows 232 of FIG. 6. The exhaust gases expand within the non-water area 220 thereby attenuating some of the exhaust energy thereof The exhaust gases then move toward the second expansion chamber 224 and enter the chamber 224 as indicated by arrows 234 of FIGS. 2 and 4. Some of the exhaust gases may travel around the lubricant reservoir member 90 before entering the second expansion chamber 224. The exhaust gases pass through the labyrinth construction of the second expansion chamber 224 to further attenuate the exhaust energy and then exit through the idle exhaust discharge port 102 to the atmosphere as indicated by the arrows 236 of FIGS. 2 and 4.

The idle exhaust gases can be accompanied by water. The illustrated driveshaft housing 56 defines a water drain 238 (FIGS. 2 and 3) at a bottom portion of the second expansion chamber 224. The water is separated from the idle exhaust gases by the labyrinth construction of the second expansion chamber 224 and is discharged outside. The water drain 238 also passes through the apron 104.

As thus described, in the illustrated arrangement, the idle exhaust gases firstly descend through the exhaust passage of the first exhaust conduit 100 to the first expansion chamber 130 and then ascend the idle exhaust path 198 of the lubricant reservoir member 90 to the non-water area 220. The idle exhaust gases thus travel far enough to lose exhaust energy. Accordingly, the exhaust noise is advantageously attenuated and the temperature of the exhaust gases falls before being discharged to the atmosphere.

In the illustrated arrangement, the idle exhaust gases can expand and contract twice in the first and second idle expansion chambers 220, 224. The exhaust gases thus can lose significant exhaust energy.

In addition, the idle exhaust gases can flow adjacent to a flow of cooling water on the lubricant reservoir member 90 in this arrangement. The construction is helpful in quickly removing energy from the idle exhaust gases.

The idle exhaust path 193 and the water discharge path 196 can be added to a known lubricant reservoir with only a small modification. Thus, a special member is not necessary to elongate the idle exhaust section. Production cost of the outboard motor thus can be greatly saved.

Of course, the foregoing description is that of a preferred construction having certain features, aspects and advantages in accordance with the present invention. For instance, the lubricant reservoir member is not necessarily used for defining the idle exhaust path. A generally vertically member can be specially and separately provided for defining the idle exhaust path. Accordingly, various changes and modifications may be made to the above-described arrangements without departing from the spirit and scope of the invention, as defined by the appended claims.

What is claimed is:

1. An outboard motor comprising a housing unit adapted to be mounted on an associated watercraft, an internal combustion engine disposed above the housing unit, the engine having a first exhaust passage to discharge exhaust gases from the engine, and a lubricant reservoir disposed below the engine, the housing unit having a second exhaust passage that communicates with the first exhaust passage and extends below the lubricant reservoir, the second exhaust passage extending to a first exhaust discharge port that communicates with an external location, the housing unit having a third exhaust passage, the lubricant reservoir having at least one wall extending generally vertically, the wall having an internal exhaust conduit that defines at least a portion of the third exhaust passage, the third exhaust passage having an inlet that communicates with the second exhaust passage at a point below the lubricant reservoir, the third exhaust passage extending upwardly to a point at about the same elevation as an upper end of the lubricant reservoir, and the third exhaust passage extending to a second exhaust discharge port that communicates with another external location and is disposed higher than the first exhaust discharge port.

2. The outboard motor as set forth in claim 1, wherein the engine defines a lubricant passage through which lubricant flows, the lubricant passage communicating with the reservoir so that the lubricant accumulates within the reservoir.

3. The outboard motor as set forth in claim 1 additionally comprising an exhaust conduit extending generally vertically, the exhaust conduit defining at least a portion of the second exhaust passage, the exhaust gases descending the exhaust conduit during operation of the engine.

4. The outboard motor as set forth in claim 3, wherein the internal exhaust conduit extends generally vertically.

5. The outboard motor as set forth in claim 3, wherein the lubricant reservoir generally surrounds the exhaust conduit.

6. The outboard motor as set forth in claim 1, wherein the lubricant reservoir generally surrounds at least a portion of the second exhaust passage.

7. The outboard motor as set forth in claim 1, wherein the housing unit has a coolant pool, the second exhaust passage comprises an expansion chamber, an upper surface of the expansion chamber is defined by a lower surface of the coolant pool.

8. The outboard motor as set forth in claim 1 additionally comprising a cooling system defining at least one coolant jacket, the coolant jacket defining a pool of coolant, the coolant jacket surrounds a portion of the second exhaust passage.

9. The outboard motor as set forth in claim 1, wherein the first exhaust discharge port is configured to be in a submerged position when the outboard motor is in a normal upright position and mounted to a watercraft floating in water.

10. The outboard motor as set forth in claim 1, wherein the second exhaust passage comprises at least two expansion chambers.

11. The outboard motor as set forth in claim 1 additionally comprising a coolant passage that extends next to a vertically extending portion of the second exhaust passage.

12. The outboard motor as set forth in claim 11, wherein the coolant passage is in the thermal communication with the vertically extending portion of the second exhaust passage.

13. An outboard motor comprising a housing unit adapted to be mounted on an associated watercraft, an internal combustion engine disposed above the housing unit, the engine having a first exhaust passage to discharge exhaust gases from the engine, the engine additionally having a lubricant passage through which lubricant flows, and a lubricant reservoir member disposed below the engine within the housing unit to define a lubricant reservoir therein, the lubricant passage communicating with the lubricant reservoir, the lubricant reservoir member having a wall that has an internal exhaust conduit that defines at least a portion of a second exhaust passage, the portion of the second exhaust passage having an inlet and an outlet disposed higher than the inlet, the housing unit having third and fourth exhaust passages, the third exhaust passage being arranged between the first and second exhaust passages, the fourth exhaust passage being arranged downstream of the second exhaust passage, the housing unit having an exhaust discharge port at an end of the fourth exhaust passage, and the exhaust discharge port communicating with an external location.

14. The outboard motor as set forth in claim 13 additionally comprising an exhaust conduit extending generally vertically along the lubricant reservoir member, the exhaust conduit defining at least a portion of the third exhaust passage, the exhaust gases descending through the exhaust conduit.

15. The outboard motor as set forth in claim 14, wherein the portion of the second exhaust passage formed in the lubricant reservoir member extends generally vertically.

16. The outboard motor as set forth in claim 14, wherein the lubricant reservoir member generally surrounds the exhaust conduit.

17. The outboard motor as set forth in claim 13, wherein the portion of the second exhaust passage extends generally vertically.

18. The outboard motor as set forth in claim 13, wherein the fourth exhaust passage expands greater than the second exhaust passage.

19. The outboard motor as set forth in claim 13, wherein the lubricant reservoir member defines a coolant passage next to the portion of the second exhaust passage, coolant flowing through the coolant passage.

20. An outboard motor comprising a housing unit adapted to be mounted on an associated watercraft, an internal combustion engine disposed above the housing unit, the engine having a first exhaust passage to discharge exhaust gases from the engine, an exhaust conduit extending generally vertically within the housing unit, the exhaust conduit defining a portion of a second exhaust passage that communicates with the first exhaust passage such that the exhaust gases descend through the exhaust conduit, and a container disposed below the engine within the housing unit, a wall of the container having an internal exhaust conduit that defines at least a portion of a third exhaust passage, the third exhaust passage communicating with the second exhaust passage, the internal exhaust conduit having an inlet positioned generally at a bottom of the container and an outlet positioned higher than the inlet, the housing unit defining a fourth exhaust passage that communicates with the third exhaust passage and has an exhaust discharge port disposed at an end of the fourth exhaust passage, and the exhaust discharge port communicating with an external location.

21. The outboard motor as set forth in claim 20, wherein the container generally surrounds the exhaust conduit.

22. The outboard motor as set forth in claim 20, wherein the container contains lubricant.

23. The outboard motor as set forth in claim 20, wherein the internal exhaust conduit extends generally vertically, the exhaust gases ascending the internal exhaust conduit from the inlet to the outlet.

24. The outboard motor as set forth in claim 20, wherein the fourth exhaust passage expands greater than the third exhaust passage.

25. The outboard motor as set forth in claim 20, wherein the container defines a coolant passage next to the internal exhaust conduit, coolant flowing through the coolant passage.

26. The outboard motor as set forth in claim 1, wherein the internal exhaust conduit extends generally vertically, and the third passage is arranged such that exhaust gases ascend through the internal exhaust conduit under at least some operating conditions of the engine.

27. The outboard motor as set forth in claim 1, wherein the second exhaust discharge port is configured to communicate with the atmosphere when the outboard motor is in a normal upright position and is mounted to a watercraft floating in water.

28. The outboard motor as set forth in claim 13, wherein the housing unit additionally has a fifth exhaust passage, the fifth exhaust passage is arranged between the third exhaust passage and a second exhaust discharge port that communicates with another external location.

29. The outboard motor as set forth in claim 13, wherein the inlet is disposed generally at a bottom of the lubricant reservoir member.

30. An outboard motor comprising a housing unit adapted to be mounted on an associated watercraft, an internal combustion engine disposed above the housing unit, the housing unit having an exhaust passage through which exhaust gases from the engine are discharged to an external location, and a lubricant reservoir member disposed below the engine within the housing unit to define a lubricant reservoir, the lubricant reservoir member having a wall that extends generally vertically, the wall having an internal exhaust conduit that defines at least a first portion of the exhaust passage, and the internal exhaust conduit having an inlet and an outlet, the outlet being disposed higher than the inlet.

31. The outboard motor as set forth in claim 30, wherein the exhaust passage has at least first and second exhaust discharge ports, the first discharge port is disposed higher than the second discharge port, and the first portion of the exhaust passage defined by the internal exhaust conduit communicates with the first discharge port.

32. The outboard motor as set forth in claim 30, wherein the outlet is arranged such that exhaust gases ascend the internal exhaust conduit from the inlet to the outlet under at least some operating conditions of the engine.

33. The outboard motor as set forth in claim 30 additionally comprising an exhaust conduit extending from the engine to a location below the lubricant reservoir member, the exhaust conduit defining a second portion of the exhaust passage, the first portion of the exhaust passage communicating with the second portion of the exhaust passage.

34. The outboard motor as set forth in claim 33, wherein the housing unit has a third portion of the exhaust passage extending below the second portion of the exhaust passage defined by the exhaust conduit, the third portion of the exhaust passage communicates with the second portion of the exhaust passage, and the third portion of the exhaust passage is isolated from the lubricant reservoir member.

35. The outboard motor as set forth in claim 34 additionally comprising a partition through which a portion of the exhaust conduit extends, the partition separating the third portion of the exhaust passage from the lubricant reservoir member.

36. The outboard motor as set forth in claim 35, wherein the first portion of the exhaust passage communicates with the third portion of the exhaust passage through the partition.

37. The outboard motor as set forth in claim 33, wherein the exhaust conduit is disposed within the outboard motor such that exhaust gases descend through the exhaust conduit under at least some operating conditions of the engine.

38. The outboard motor as set forth in claim 33, wherein the lubricant reservoir member generally surrounds the exhaust conduit.

39. The outboard motor as set forth in claim 30, wherein the inlet is disposed generally at a bottom of the lubricant reservoir member.

40. An outboard motor comprising a housing unit adapted to be mounted on an associated watercraft, an internal combustion engine disposed above the housing unit, the housing unit having an exhaust passage through which exhaust gases from the engine are discharged to an external location, and a lubricant reservoir member disposed below the engine within the housing unit to define a lubricant reservoir, the lubricant reservoir member having a wall that extends generally vertically, the wall forming an opening that defines at least a first portion of the exhaust passage, and the opening having an inlet and an outlet, the outlet being disposed higher than the inlet, an exhaust conduit extending from the engine to a location below the lubricant reservoir member, the exhaust conduit defining a second portion of the exhaust passage, the first portion of the exhaust passage communicating with the second portion of the exhaust passage, the housing unit containing a third portion of the exhaust passage that extends below the second portion of the exhaust passage defined by the exhaust conduit, the third portion of the exhaust passage communicating with the second portion of the exhaust passage, the housing unit also containing a partition through which a portion of the exhaust conduit extends, the partition separating the third portion of the exhaust passage from the lubricant reservoir member to isolate the third portion of the exhaust passage from the lubricant reservoir member, the housing unit and the partition defining at least in part a coolant pool between the lubricant reservoir member and the partition.

* * * * *